US007823506B2

(12) United States Patent
Menu et al.

(10) Patent No.: US 7,823,506 B2
(45) Date of Patent: Nov. 2, 2010

(54) PRINTING UNIT HAVING DIFFERENT EXTENTS OF MOVEMENT OF THE BLANKET CYLINDERS IN ORDER TO REACH A THROW-OFF CONFIGURATION AND CORRESPONDING PRINTING PRESS

(75) Inventors: Patrick Menu, Breuil le Vert (FR); Francois-Marcel-Adrien Recolet, Breuil le Vert (FR); Jean Valere Holvoet, Nointel (FR)

(73) Assignee: Goss International Montataire SA, Montataire (FR)

( * ) Notice: Subject to any disclaimer, the term of this patent is extended or adjusted under 35 U.S.C. 154(b) by 422 days.

(21) Appl. No.: 11/645,031

(22) Filed: Dec. 22, 2006

(65) Prior Publication Data

US 2007/0144370 A1 Jun. 28, 2007

(30) Foreign Application Priority Data

Dec. 27, 2005 (FR) ..... 05 13377

(51) Int. Cl.
*B41F 13/24* (2006.01)
*B41F 5/04* (2006.01)
*B41F 7/02* (2006.01)

(52) U.S. Cl. ..... 101/247; 101/218; 101/220

(58) Field of Classification Search ..... 101/137, 101/139, 140, 191, 218, 219, 220, 229, 221, 101/247

See application file for complete search history.

(56) References Cited

U.S. PATENT DOCUMENTS 3,664,261 A * 5/1972 Dahlgren ..... 101/177
3,785,287 A * 1/1974 Dahlgren ..... 101/247
4,369,705 A * 1/1983 Gelinas ..... 101/177
4,458,590 A * 7/1984 Egnaczak et al. ..... 101/247

(Continued)

FOREIGN PATENT DOCUMENTS

DE 197 53 820 A1 6/1999

(Continued)

OTHER PUBLICATIONS

Mike Thompson, "Zero Makeready Format", Sunday 2000—Auto Transfer WOA Conference, May 7, 2003, Nashville, Tennessee.

*Primary Examiner*—Judy Nguyen
*Assistant Examiner*—David Banh
(74) *Attorney, Agent, or Firm*—Davidson, Davidson & Kappel, LLC

(57) ABSTRACT

A printing unit for printing a web of paper is provided. The printing unit includes a frame and at least an upper printing group and a lower printing group, each printing group including a blanket cylinder and a plate cylinder. The printing unit also including a cylinder support and movement and having at least one throw-on configuration in which the blanket cylinders are pressed against each other and against the plate cylinders, and at least one throw-off configuration in which the blanket cylinders are spaced apart from each other. In the throw-off configuration, the upper blanket cylinder has been raised by a first height relative to the position which it occupies in a throw-on configuration, and the lower blanket cylinder has been lowered by a second height relative to the position which it occupies in a throw-on configuration, and the second height is different from the first height.

12 Claims, 9 Drawing Sheets

U.S. PATENT DOCUMENTS

| | | | | | |
|---|---|---|---|---|---|
| 4,807,527 | A | * | 2/1989 | Knauer | 101/216 |
| 5,150,650 | A | * | 9/1992 | Murakami | 101/425 |
| 5,337,664 | A | * | 8/1994 | Hannon | 101/218 |
| 5,678,485 | A | | 10/1997 | Guaraldi | |
| RE35,646 | E | | 11/1997 | Guaraldi et al. | |
| 5,813,336 | A | * | 9/1998 | Guaraldi et al. | 101/218 |
| 5,943,955 | A | * | 8/1999 | Niemiro et al. | 101/216 |
| 6,019,039 | A | | 2/2000 | Knauer et al. | |
| 6,085,651 | A | | 7/2000 | Defrance et al. | |
| 6,109,180 | A | * | 8/2000 | Guaraldi et al. | 101/466 |
| 6,227,111 | B1 | * | 5/2001 | Dawley et al. | 101/218 |
| 6,575,010 | B2 | * | 6/2003 | Colman et al. | 73/1.73 |
| 6,817,290 | B2 | * | 11/2004 | Niemiro et al. | 101/216 |
| 7,146,907 | B2 | * | 12/2006 | Niemiro et al. | 101/216 |
| 2001/0035104 | A1 | * | 11/2001 | Gottling et al. | 101/248 |
| 2001/0050011 | A1 | * | 12/2001 | Backer et al. | 101/232 |
| 2002/0112626 | A1 | * | 8/2002 | Emery et al. | 101/247 |
| 2006/0219115 | A1 | * | 10/2006 | Gentle et al. | 101/415.1 |
| 2006/0225590 | A1 | * | 10/2006 | Dawley et al. | 101/217 |
| 2007/0022885 | A1 | * | 2/2007 | Zlatin et al. | 101/218 |
| 2007/0039493 | A1 | * | 2/2007 | Metrope | 101/218 |
| 2007/0039494 | A1 | * | 2/2007 | Chrigui | 101/218 |

FOREIGN PATENT DOCUMENTS

| | | | | |
|---|---|---|---|---|
| EP | 0 862 999 | A2 | | 9/1998 |
| EP | 0 956 951 | A1 | | 11/1999 |
| GB | 2 331 961 | A | | 6/1999 |
| JP | 57109690 | A | * | 7/1982 |
| JP | 07096598 | A | * | 4/1995 |
| JP | 2003136371 | A | * | 5/2003 |

* cited by examiner

PRINTING UNIT HAVING DIFFERENT EXTENTS OF MOVEMENT OF THE BLANKET CYLINDERS IN ORDER TO REACH A THROW-OFF CONFIGURATION AND CORRESPONDING PRINTING PRESS

This application claims the benefit of French Application No. 05 13377 filed Dec. 27, 2005 and hereby incorporated by reference herein.

The present invention relates to a unit for printing a web of paper, of the type including a frame and at least an upper printing group and a lower printing group, each printing group including a blanket cylinder and a plate cylinder.

The invention is used in particular for offset presses, for example, for printing books.

BACKGROUND

A press is known from the computer-aided presentation carried out at the WOA conference at Nashville on 7 May 2003, relating to the Sunday 2000-Auto Transfer press (registered trade marks).

The throw-on configuration allows the printing unit to print the web of paper which passes between the blanket cylinders.

A first throw-off configuration is the idle throw-off configuration, in which the unit is non-operational.

In a second throw-off configuration, referred to below as the plate-changing throw-off configuration, the blanket cylinder of each printing group is pressed against the plate cylinder of the same group but remains spaced apart from the blanket cylinder of the other printing group.

The idle and plate-changing throw-off configurations allow the web of paper to pass between the blanket cylinders of the two printing groups and thus to pass through the printing unit which is not carrying out any printing operation. The web of paper can at the same time continue to be printed by other printing units.

This allows a printing operation to be carried out by some units within the same printing press while the plates of other units are changed to prepare for the following printing operation.

It is thus possible to change printing operation without cutting the web of paper and the losses of paper when a printing operation is changed are limited.

Furthermore, it is possible to prepare a printing operation simultaneously, that is to say, while another printing operation is carried out.

A press of this type, generally referred to as an "Auto Transfer" press (registered trade mark) allows time to be saved with a high level of use and therefore allows costs to be reduced.

SUMMARY OF THE INVENTION

An object of the invention is to further improve this type of press by limiting the risks of contact between the blanket cylinders of a printing unit which is placed in a throw-off configuration and the web of paper which is passing through it.

The present invention provides a unit for printing a web of paper, of the type including a frame and at least an upper printing group and a lower printing group, each printing group including a blanket cylinder and a plate cylinder, the printing unit also including a cylinder support and movement mechanism, the printing unit having at least one throw-on configuration in which the blanket cylinders are pressed against each other and against the plate cylinders, and at least one throw-off configuration in which the blanket cylinders are spaced apart from each other, wherein, in the throw-off configuration, the upper blanket cylinder has been raised by a first height relative to the position which it occupies in a throw-on configuration, and the lower blanket cylinder has been lowered by a second height relative to the position which it occupies in a throw-on configuration, and the second height is different from the first height.

According to specific embodiments of the invention, the unit may include one or more of the following features, taken in isolation or according to any technically possible combination:

- the second height is strictly greater than the first height;
- a throw-off configuration is a plate-changing throw-off configuration in which the blanket cylinders are pressed against the plate cylinders of their respective printing groups;
- a throw-off configuration is a blanket-changing throw-off configuration in which the blanket cylinders are spaced apart from the plate cylinders of their respective printing groups;
- a throw-off configuration is an idle throw-off configuration in which the blanket cylinders are spaced apart from the plate cylinders of their respective printing groups;
- in the idle throw-off configuration, the width of the space between the blanket cylinder and the plate cylinder of at least one of the printing groups is greater than the width of the same space when the unit is in a blanket-changing throw-off configuration;
- in the idle throw-off configuration, the support and movement mechanism is capable of allowing, for at least one printing group, a movement of the blanket cylinder and/or the plate cylinder so that, in the idle throw-off configuration, the width of the space between the blanket cylinder and the plate cylinder of the printing group is greater than the width of the same space when the press is in a blanket-changing throw-off configuration;
- the support and movement mechanism includes receiving arms of the cylinders, the receiving arms being articulated to the frame in order to be able to pivot about axes parallel with the plate cylinder and blanket cylinder and the ends of the cylinders are supported in the receiving arms;
- the support and movement mechanism further includes connections between the receiving arms which receive the blanket cylinder and plate cylinder of the same printing group; and
- in the or each throw-off configuration, an adequate space is provided between the blanket cylinders to allow a web of paper printed by another printing unit to pass between them.

The invention also provides to a printing press, wherein the printing press includes at least one upstream printing unit and one downstream printing unit, the downstream printing unit being a unit as defined above.

In another preferred embodiment, the press may not have additional supports for the web of paper between the upstream printing unit and the downstream printing unit.

BRIEF DESCRIPTION OF THE DRAWINGS

The invention will be better understood from a reading of the following description, given purely by way of example and with reference to the appended drawings, in which.

DETAILED DESCRIPTION OF PREFERRED EMBODIMENTS

Figure 1:
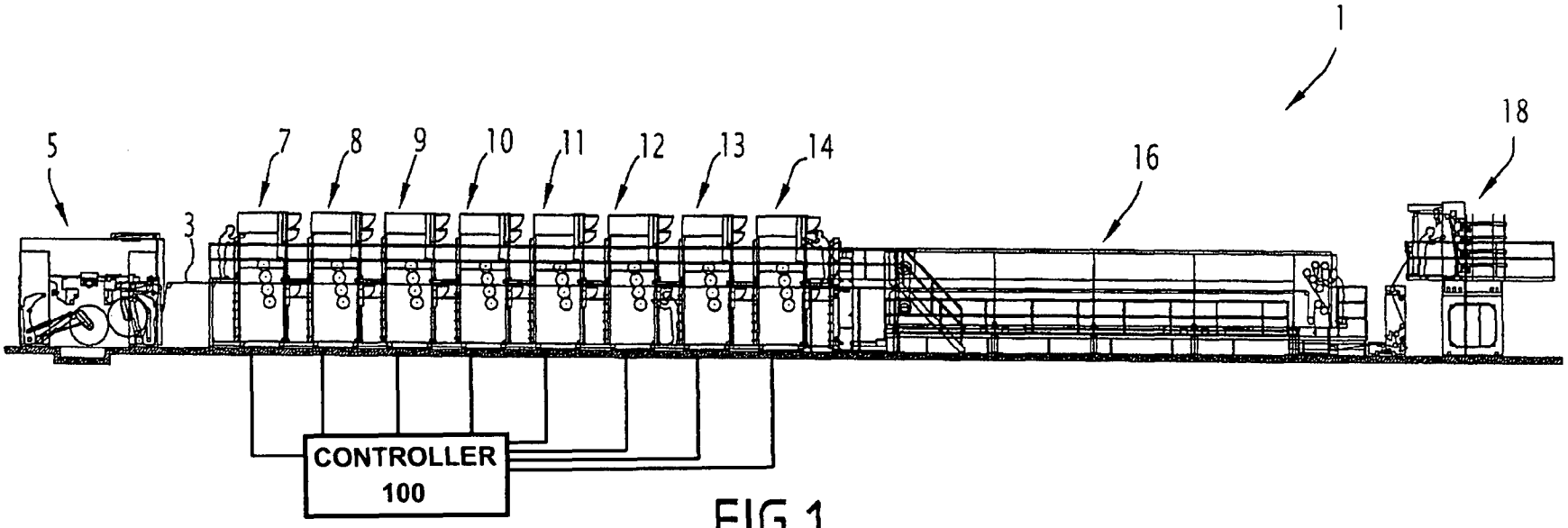
FIG. 1 is a schematic side view of a printing press according to the invention.

FIG. 1 illustrates a rotary offset press 1 which is intended to print a web 3 of paper. In the example illustrated, the passage of the web 3 is horizontal, that is to say, it will move horizontally, more specifically, from left to right.

The press 1 principally includes, successively along the movement direction of the web 3 of paper, unwinding devices which are designated 5, printing units 7 to 14, a dryer/cooler 16 and at least one folding device 18.

The printing units 7 and 8 are, for example, intended to print in black, the units 9 and 10 in cyan, the units 11 and 12 in magenta and the units 13 and 14 in yellow.

The printing units 7 to 14 have similar structures and only that of the unit 8 will now be described with reference to FIG. 2.

The unit 8 is a dual printing unit which includes two printing groups 20A and 20B which are arranged one above the other.

The upper printing group 20A and the lower printing group 20B have similar structures so that only that of the group 20A will be described below and the structural differences between the groups 20A and 20B will be indicated. The numerical references used for the groups 20A and 20B are distinguished by the use of the suffixes A and B.

The printing group 20A principally includes a blanket cylinder 22A, a plate cylinder 24A, an inking system, a wetting system and optionally an automated or semi-automated system for changing plates. These various systems are conventional and are not illustrated. In the example illustrated, the blanket cylinder 22A is intended to receive blankets which are tubular, that is to say, in the form of sleeves.

Figure 9:
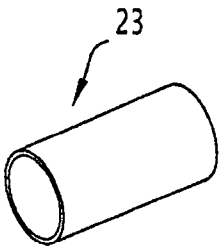
FIG. 9 is a schematic perspective drawing of a tubular blanket which is capable of being used with the press of FIG. 1.

A tubular blanket 23 of this type is illustrated schematically in FIG. 9.

The printing unit 8 also includes a mechanism 26 for supporting and moving the cylinders 22A, 22B, 24A and 24B. This mechanism 26, and the other elements which have been mentioned above, are carried by the frame 28 of the printing unit 8. The frame 28 includes two lateral walls 29 between which the cylinders 22A, 22B, 24A and 24B extend. Only one wall 29 can be seen in FIG. 2.

The support mechanism 26 includes two assemblies 30, each of which is arranged at one side of the printing unit 8 and is carried by the corresponding lateral wall 29 of the frame 28. The two assemblies 30 have similar structures. Only that of the assembly 30 which can be seen in FIG. 2 will be described below and the differences between the two assemblies 30 will be indicated.

The assembly 30 includes receiving arms of the blanket cylinders 22A and 22B, designated 32A and 32B, respectively, and receiving arms of the plate cylinders 24A and 24B, designated 34A and 34B, respectively.

The arms 32A, 32B, 34A, 34B are articulated to the wall 29 at points 36A, 36B, 38A and 38B which allow them to pivot relative to the frame 28 parallel with the axes A22A, A22B, A24A and A24B of the cylinders 22A, 22B, 24A and 24B.

Figure 2:
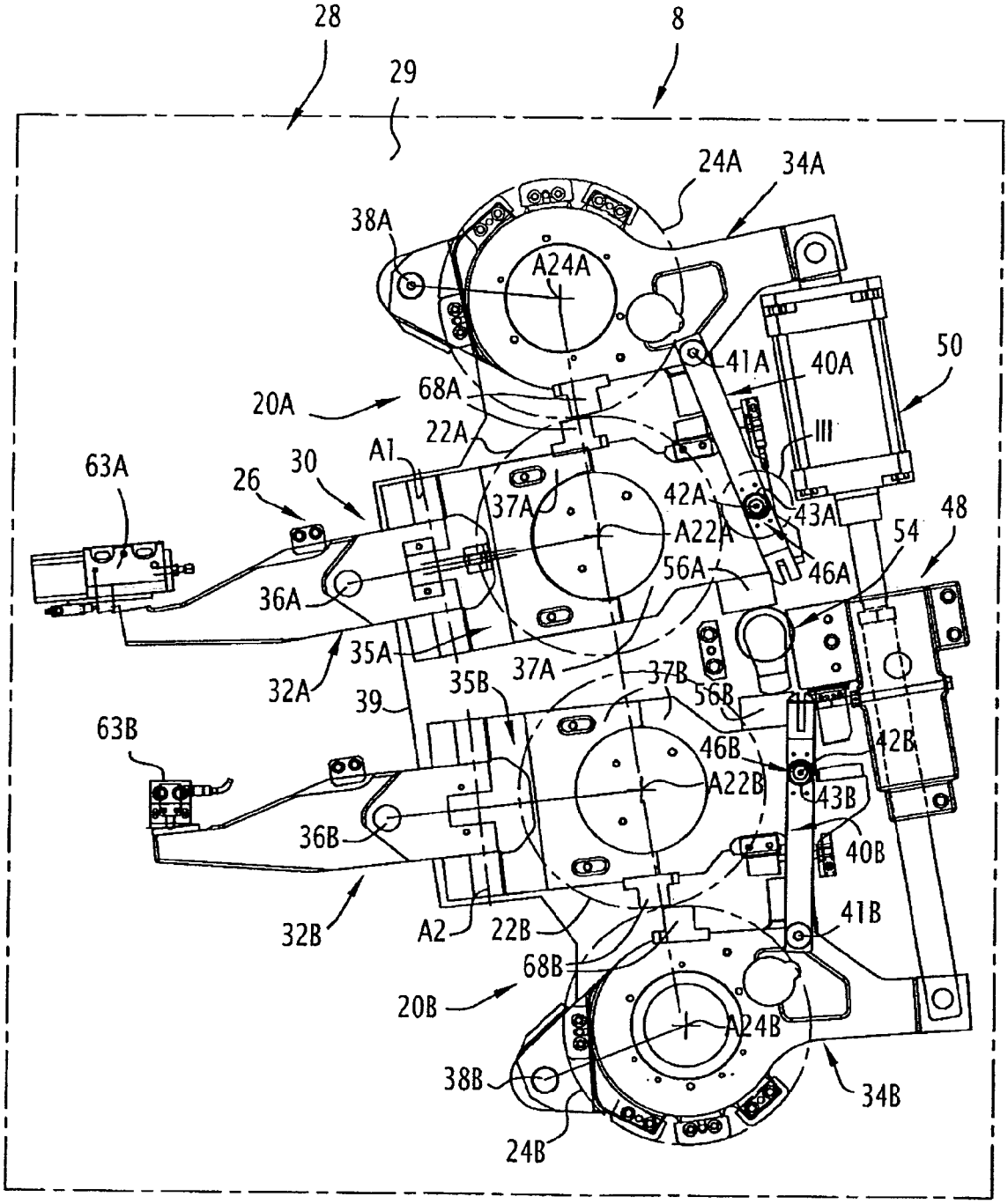
FIG. 2 is a schematic side view, drawn to an enlarged scale, illustrating the mechanism for supporting and driving the cylinders of a printing unit of the press of FIG. 1, with FIG. 2 being taken from inside the unit.

In the example illustrated, the articulation points 36A and 36B are located in an intermediate region of the arms 32A and 32B and the articulation points 38A and 38B are located at the left-hand ends of the arms 34A and 34B (FIG. 2).

The ends of the cylinders 22A, 22B, 24A and 24B located at the side of the assembly 30 are rotatably received in the arms 32A, 32B, 34A and 34B, respectively, via bearings. Each cylinder can thus rotate about its respective axis A22A, A22B, A24A and A24B.

This rotation of the cylinders is carried out under the action of a driving motor which can be common to the whole of the printing unit 8, or, for example, under the action of a separate motor for each printing group 20A and 20B, or under the action of four separate driving motors which each drive a cylinder.

The bearings of the arms 32A and 32B which receive the ends of the blanket cylinders 22A and 22B are themselves received in doors 35A and 35B, respectively, which can pivot outwards relative to the remainder of the arms 32A and 32B about axes A1 and A2, in order to release the bearings and the corresponding ends of the cylinders 22A and 22B.

More precisely, the doors includes jaws 37A and 37B for holding the bearings. At least one of the jaws 37A and 37B can be moved in order to be able to release the corresponding bearing.

In this manner, in order to release, for example, the end of the blanket cylinder 22A, the jaws 37A are released by displacing the one which can be moved, then the door 35A is opened by pivoting about the axis A1. The door 35A then passes through an opening 39 which is provided in the wall 29.

It is possible to change the blanket via translation along the blanket cylinder 22A and passage through the opening 39. Doors 35A and 35B and jaws 37A, 37B of this type are provided in only one of the assemblies 30, in this instance the one which is illustrated in FIG. 2.

In order to be able to ensure the horizontal retention of the blanket cylinders 22A and 22B, while the bearings located at the side of the assembly 30 of FIG. 2 are no longer supported by the doors 35A and 35B, systems forming counter-weights are, for example, provided at the side of the other assembly 30.

Such door systems 35A and 35B and jaw systems 37A and 37B and such counter-weight systems are conventional and are described, for example, in documents U.S. Pat. No. RE 35,646 and U.S. Pat. No. 5,678,485, respectively. They will therefore not be described in greater detail below.

The assembly 30 also includes rods 40A and 40B which connect the arms 32A and 34A and the arms 32B and 34B, respectively. Their structure is similar and only that of the rod 40A will be described below.

The rod 40A is articulated to the arm 34A by an articulation point 41A. The rod 40A is connected, via a pin 42A, to the right-hand end of the arm 32A. The pin 42A is received in a housing 43A of the rod 40A which extends slightly along the rod 40A. The pin 42A can thus move in translation along the rod 40A, affording a possibility of clearance which may be approximately 4.5 mm, for example, although this numerical value is by no means limiting. The pin 42A also affords a possibility of pivoting the rod 40A relative to the arm 32A.

When the plate cylinder 24A and blanket cylinder 22A have toothed wheels in engagement, the possibility of clearance between the rod 40A and the arm 32A is preferably determined so as not to produce disengagement of these toothed wheels when the arms 32A and 34A are mutually spaced-apart.

When the door 35A is opened, the pin 42A follows the door 35A and leaves the housing 43A. It is possible to provide a support or other structure for retaining the rod 40A in position so that, when the door 35A is closed, the pin 42A can be re-engaged directly in the housing 43A.

Figure 3:
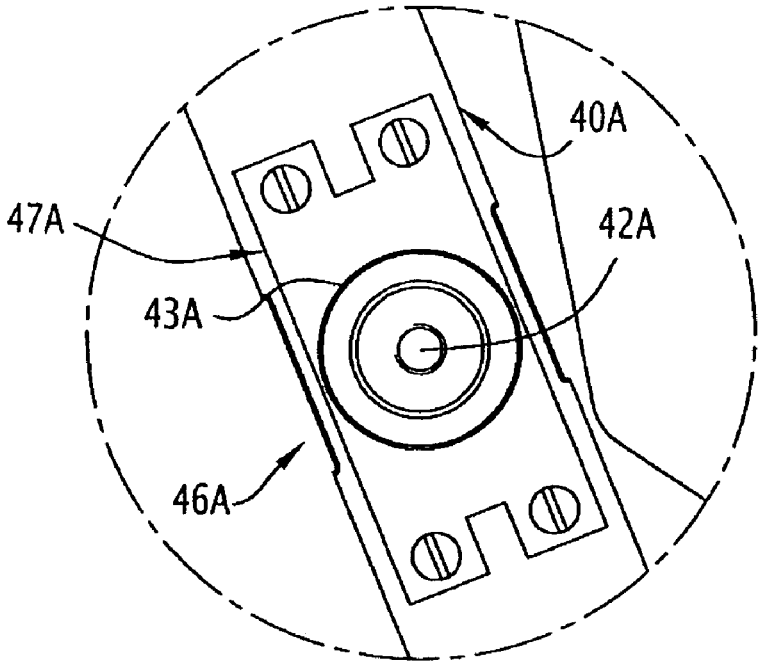
FIG. 3 is an enlarged schematic view of the circled portion III of FIG. 2, FIGS. 4 to 7 are lateral kinematic representations illustrating different configurations of the printing unit of FIG. 2.

The rod 40A has, in the region of the housing 43A, a region 46A of lesser strength formed by a local narrowing (FIG. 3). This region 46A of lesser strength has been dimensioned so as break under a predetermined traction force.

According to a variant, the unit 8 may include a detector 47A for detecting breakage of the rod 40A. This is, for example, a printed circuit board which is arranged on the rod 40A in the region of the region 46A. This detector 47A is connected to the control unit 100 of the press 1 in order, when a breakage of the rod 40A has been detected, to bring about an emergency stop of the press 1 and to move all the units 7 to 14 into an idle throw-off configuration.

The printing unit 8 includes a system 48 for activating the mechanism 26 for moving and supporting the cylinders.

This system 48 includes similar elements at each side of the unit 8, and only the elements provided at the lateral side illustrated in FIG. 2 will be described below with reference to FIG. 4.

The system 48 includes a main jack 50 for moving the receiving arms 34A and 34B of the plate cylinders 24A and 24B. This jack 50 is, for example, a dual-effect pneumatic jack. It is, for example, supplied with compressed air by a valve 52 having four holes and two positions (FIG. 4) connected to a source 53 of compressed air. The jack 50 extends between the right-hand ends of the receiving arms 34A and 34B and is articulated thereto.

Figure 4:
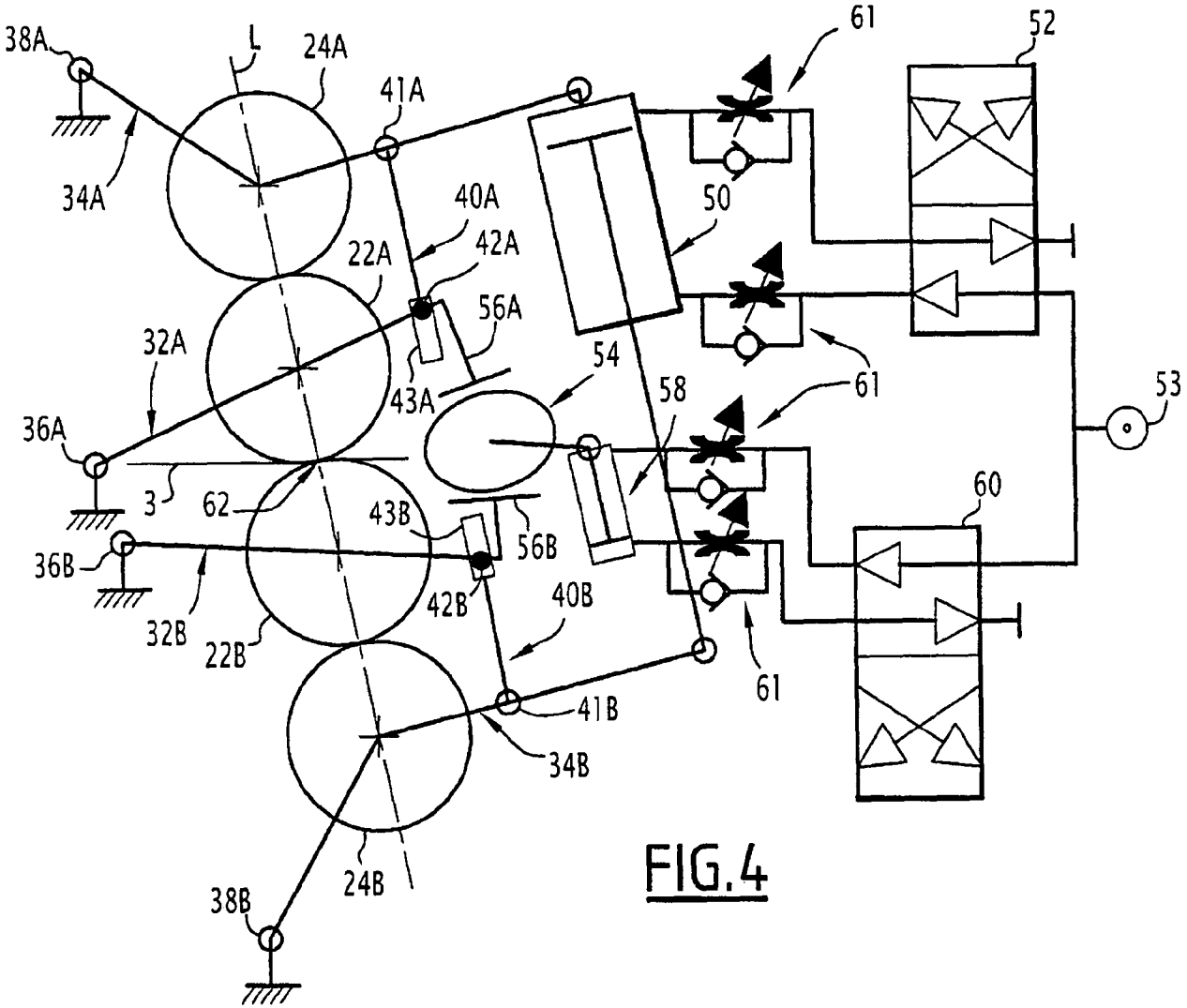
Figure 5:
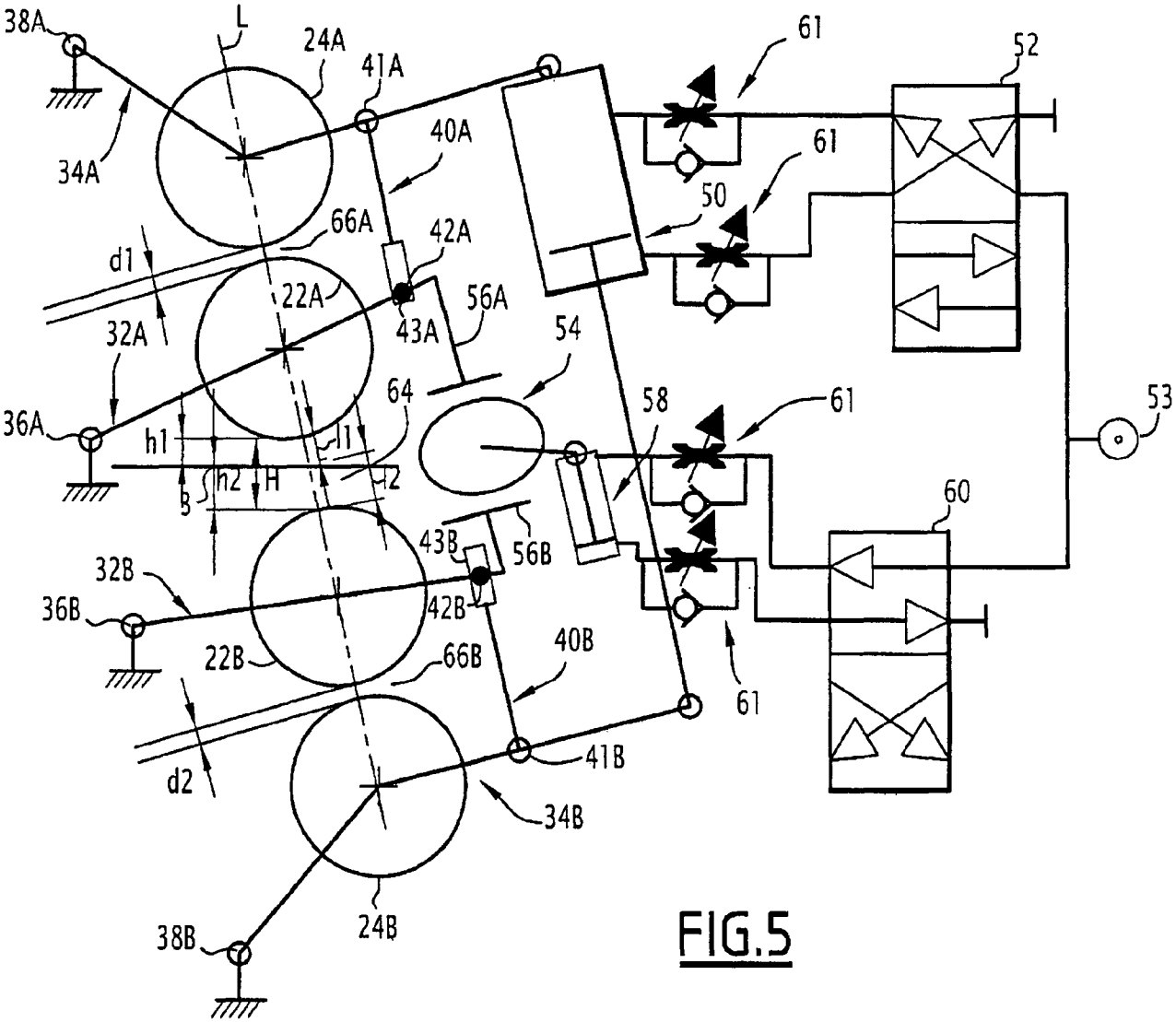

The jack 50 has, in particular, a retracted configuration (FIG. 4) and an extended configuration (FIG. 5).

The activation system 48 also includes a cam 54 for moving apart the receiving arms 32A and 32B of the blanket cylinders 22A and 22B. This cam 54 is intended to co-operate with stops 56A and 56B carried by the receiving arms 32A and 32B.

Figure 6:
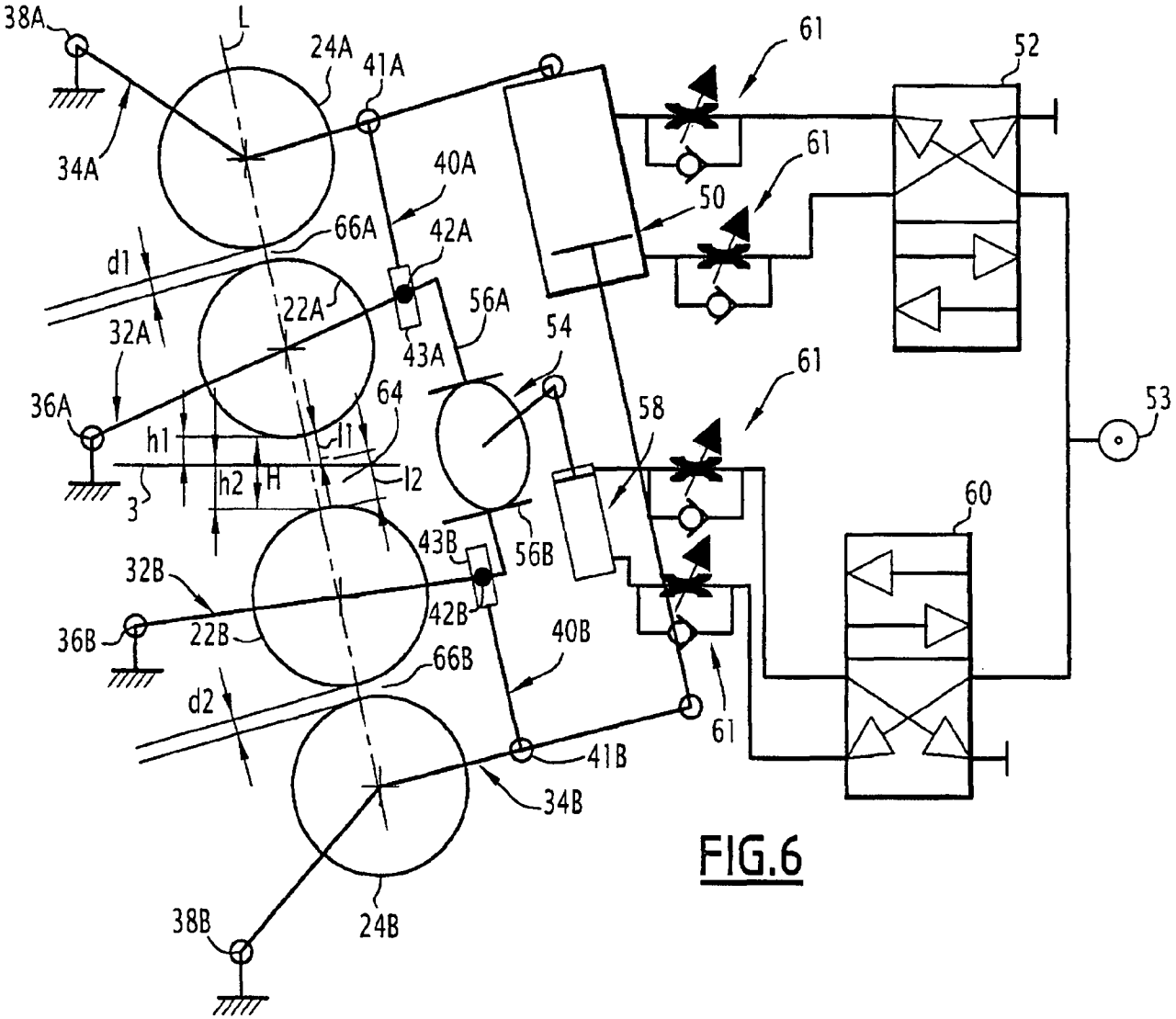
Figure 7:
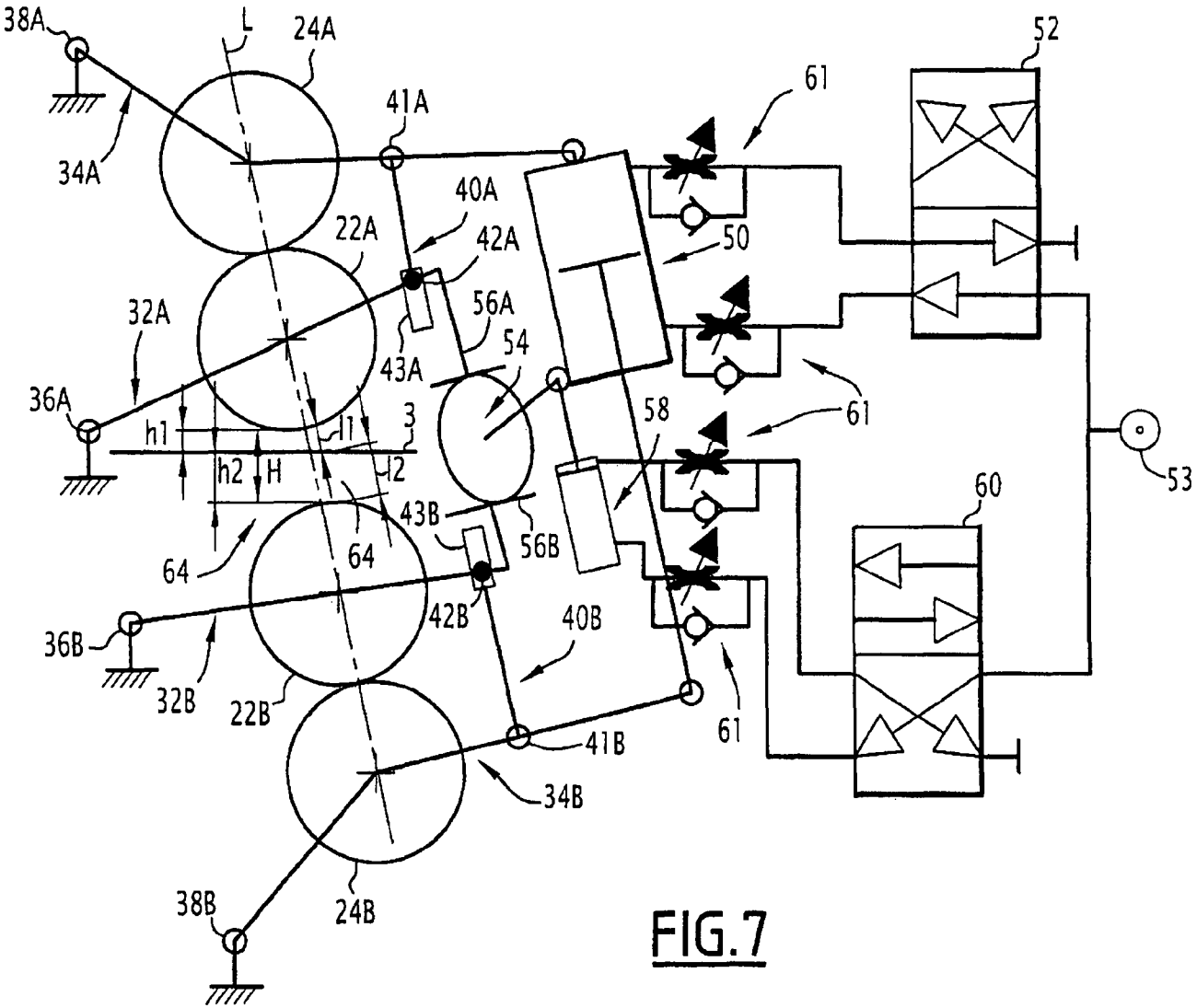

The cam 54 can be moved in rotation relative to the frame 28 between a spaced-apart position and a mutually close position of the arms 32A and 32B. The spaced-apart position of the arms is illustrated in FIGS. 2, 6 and 7. The cam 54 is in abutment against the stops 56A and 56B. In its mutually close position of the arms, the cam 54 is not in abutment against the stops 56A and 56B. This position is illustrated in FIGS. 4 and 5.

The cam 54 can be moved between its above-mentioned positions under the action of an auxiliary jack 58 which is, for example, a dual-effect jack. The jack 58 is supplied with compressed air by a valve 60 having four holes and two positions.

The auxiliary jack 58 provides a retracted configuration (FIGS. 4 and 5) and an extended configuration (FIGS. 2, 6 and 7).

Output limitation devices 61 are interposed on the pneumatic circuits between the jacks 50 and 58 and the valves 52 and 60 in order to provide gentle movements of the cylinders 22A, 22B, 24A and 24B.

The support and movement mechanism 26 of the cylinders and the activation system 48 thereof allow the printing unit 8 to have a throw-on configuration and three throw-off configurations, that is to say, a plate-changing throw-off configuration, a blanket-changing throw-off configuration and an idle throw-off configuration.

These different configurations will now be described with reference to FIGS. 4 to 7. In this description, reference will be made only to the elements of the mechanism 26 and the activation system 48 located at the side illustrated, remembering that similar elements are arranged at the other side of the press.

FIG. 4 illustrates the throw-on configuration. The blanket cylinders 22A and 22B and the plate cylinders 24A and 24B are pressed against each other. The main jack 50 and the auxiliary jack 58 are in retracted configurations and the cam 54 is in a mutually close position of the receiving arms 32A and 32B of the blanket cylinders 22A and 22B.

The unit 8 can then print the web 3 of paper which moves between the cylinders 22A and 22B in the region of a pinch point 62 ("nip").

Conventionally, during the printing operation, the cylinders 22A, 22B, 24A and 24B are driven in rotation about their respective centre axes.

The plate(s) carried by the plate cylinders 24A and 24B are moistened then inked by the inking and moistening systems. These plates transfer the ink from the printing regions thereof to the blankets carried by the cylinders 22A and 22B which in turn transfer the ink to the web 3 which is thus printed on both sides thereof.

In the idle throw-off configuration illustrated in FIG. 5, the valve 52 has been controlled so that it changes position. The main jack 50 has thus moved into the extended configuration thereof. The receiving arms 34A and 34B of the plate cylinders 24A and 24B have been moved apart relative to the position which they occupy in the throw-on configuration.

More precisely, the receiving arm 34A has been raised by pivoting about the point 38A and the receiving arm 34B has been lowered by pivoting about the point 38B.

The arm 34A has carried with it, via the rod 40, the arm 32A which has also pivoted upwards about the point 36A. The blanket cylinder 22A has therefore been raised. The receiving arm 32B has pivoted downwards about the point 36B, under the action of its own weight and that of the blanket cylinder 22B, and rests against a fixed stop 63B (FIG. 2).

A space 64 is then provided between the blanket cylinders 22A and 22B.

It should be noted that the space 64 has been formed by the upper blanket cylinder 22A being raised to a lesser extent than the lower blanket cylinder 22B is lowered.

In this manner, the movement I1 of the upper blanket cylinder 22A along the line L which intersects the axes of the cylinders is, in the example described, approximately 8.3 mm while the movement I2 along the same line L of the lower blanket cylinder 22B is approximately 20 mm, for example.

The upper blanket cylinder 22A has therefore moved vertically by a height h1 of approximately 5 mm, for example, relative to the position which it occupied in the throw-on configuration. In the same manner, the lower blanket cylinder 22B has moved by a height h2 of approximately 17 mm, for example, relative to the position which it occupied in the throw-on configuration.

In the same manner, spaces 66A and 66B of widths d1 and d2 along the line L have been formed between the blanket cylinder 22A and plate cylinder 24A and the blanket cylinder 22B and plate cylinder 24B, respectively. These widths are, for example, 3.5 and 1.8 mm, respectively.

Owing to the possibility of clearance of the lower pin 42B in the housing 43B of the rod 40B, the lower blanket cylinder 22B can be raised relative to the lower plate cylinder 24B, in particular in circumstances which will be described below.

The configuration of FIG. 5 is a configuration in which the space 64 has a height H which is sufficient to allow the web 3 printed by the printing unit 7 to pass through without touching the blanket cylinders 22A and 22B.

This is also an emergency stop configuration which the printing unit 8 will adopt in the event of an incident, in particular in the event of the web 3 breaking.

In such a case, the web 3 is at risk of becoming wound around one of the blanket cylinders 22A and 22B. If it is wound around the upper blanket cylinder 22A, the space 66A, which is larger than in the other configurations described below, leaves more space for the web 3 to become wound and therefore limits the risks of damage to the upper cylinders, in particular the blanket cylinder 22A.

If the web 3 of paper is wound around the lower blanket cylinder 22B, it will be raised by pivoting the arm 32B upwards as the inner space 66B is filled by the web 3 of paper which is being wound, until it reaches a width d2 of, for example, 3.5 mm along the line L.

The idle throw-off configuration therefore constitutes a first safety measure which allows the risks of damage to the cylinders to be limited in the event of a breakage of the web 3.

If one of the spaces 66A or 66B is completely filled by the wound web 3 of paper, the rod 40A or 40B, respectively, will break in the region 46A or 46B thereof as soon as the predetermined force has been reached. The corresponding space 66A or 66B will then be able to further increase, thus limiting the risks of damage to the cylinders.

The broken rods 40A or 40B will be able to be subsequently replaced at a much lower cost than that involved in replacing the blanket cylinder 22A or 22B, or another component of the mechanism 26. The rods 40A and 40B therefore act as mechanical fuses.

The existence of zones 46A and 46B of lesser strength in the rods 40A and 40B therefore constitutes a second safety measure for limiting the risks of damage to the cylinders.

FIG. 6 illustrates the blanket-changing throw-off configuration.

In order to move into this configuration, the valve 60 has been controlled so that it changes position and the auxiliary jack 58 has moved into an extended position. The cam 54 has therefore moved into a spaced-apart position of the arms 32A and 32B. The arm 32A has thus pivoted upwards about the point 36A, raising the upper blanket cylinder 22A.

Owing to the possibility of clearance of the pin 42A in the rod 40A, the distance d1 has therefore decreased, for example, by 1.7 mm to a level of 1.8 mm, and the distance I1 has increased by the same amount to a level of 10 mm. The space 66A is therefore smaller than in the idle throw-off configuration but the space 64 is larger.

A stop 63A (FIG. 2) was then activated in order to press on the end (at the left-hand side in FIG. 2) of the arm 32A, thus preventing the downward movement thereof. In the same manner, the left-hand end of the arm 32B is still in abutment against the fixed stop 63B. It should be noted that no stop 63A or 63B is provided at the opposite side of the unit 8 to that illustrated in FIG. 2.

It is then possible in this configuration to change the tubular blankets by causing them to slide along the cylinders 22A and 22B, after operating the counter-weights, moving the cam 54 located at the side of the unit 8 illustrated in FIG. 2 into a mutually close position of the arms 32A and 32B, releasing the jaws 37A and 37B and opening the doors 35A and 35B.

Since the space 64 is larger than in the idle throw-off configuration, the blanket changing operation can also be carried out on the printing unit 8 while other units of the press carry out a printing operation.

FIG. 7 illustrates the plate-changing throw-off configuration.

Compared with the blanket-changing throw-off configuration, the valve 52 has been controlled in order to bring the jack 50 into an intermediate configuration between the extended and retracted configurations thereof.

The lower plate cylinder 24B has thus been raised by pivoting the arm 34B upwards about the point 38B until it comes into abutment against the lower blanket cylinder 22B. In the same manner, the upper plate cylinder 24A has been lowered, by the arm 34A being pivoted downwards, until it comes into abutment against the blanket cylinder 22A.

The plate cylinders and blanket cylinders of each of the groups 20A and 20B are pressed against each other.

Stops 68A and 68B (FIG. 2) carried by the arms 32A, 32B, 34A and 34B are in abutment against each other.

It should be noted that the arms 32A and 32B are prevented from being moved close together by the cam 54 and the stop 63A. The space 64 of the blanket-changing throw-off configuration is preserved.

The plate-changing throw-off configuration allows the plates to be removed and positioned on the plate cylinders 24A and 24B, for example, using a manual, automated or semi-automated method.

Again in this instance, the space 64 has an overall height H sufficient to allow the web 3 to be able to pass through the printing unit 8, for example, after having been printed by the printing unit 7, without touching the blanket cylinders 22A and 22B.

The printing unit 8 can therefore be prepared by installing the printing plates for a subsequent printing operation while the printing press 1 carries out another printing operation.

The throw-off configurations described above therefore allow some units of the press, for example, 8, 10, 12 and 14, to be prepared while other printing units, for example, 7, 9, 11, 13, carry out another printing operation. The change from one printing operation to another can therefore be carried out without interruption, that is to say, while the web 3 of paper is traveling, even at full speed, without the need for the web of paper to be cut or reengaged.

Losses of paper are therefore reduced.

Furthermore, some printing units of the press 1 can be prepared simultaneously, that is to say, while a printing operation is carried out by some other units of the press 1. Even the blanket changing operation for some units can be carried out while the press 1 carries out a printing operation.

The press thus allows even more time to be saved, is able to have an even higher rate of use and thus reduces costs to an even greater extent.

The fact that the lower blanket cylinders 22B move to a greater extent than the upper blanket cylinders 22A, compared with the throw-on configuration, in order to reach the throw-off configurations, also allows the web 3 of paper to move from one printing unit to the other, avoiding the guiding means between various printing units.

The web 3 of paper will have, owing to its weight and the inclination of the lines L in the printing units, a downward deflection f between two printing units which are placed in a throw-on configuration.

Figure 8:
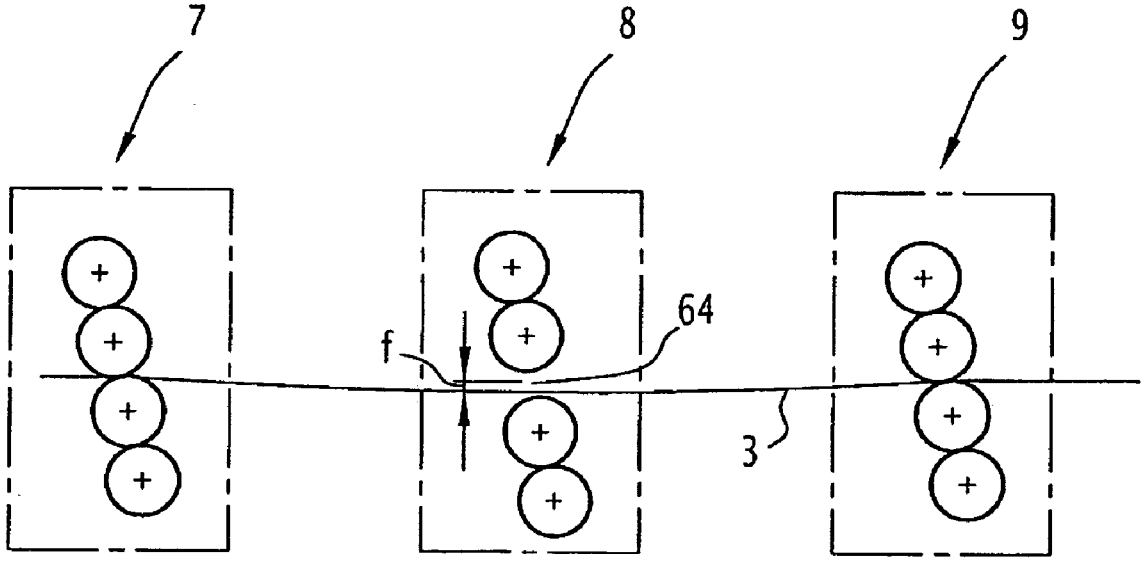
FIG. 8 is a schematic side view illustrating three successive printing units of the press of FIG. 1.

This is illustrated in FIG. 8 in which only the printing units 7 to 9 have been illustrated, the units 7 to 9 being in a throw-on configuration and the printing unit 8, located downstream of the unit 7 and upstream of the unit 9, being in a plate-changing throw-off configuration.

In the space 64 which is provided between the blanket cylinders 22A and 22B of the printing unit 8, the web 3 of paper is, owing to the deflection f, located at a lower level than that which it would occupy if the printing unit 8 were in a throw-on configuration. Since the height h2 (FIG. 7) is greater than the height h1, the risks of the web 3 coming into contact with the lower blanket cylinder 22B are therefore reduced and it is not necessary to provide means for guiding the web 3 between the unit 8 and the units 7 and 9.

When the printing units have other structures, for example, with lines L inclined relative to the vertical in an opposite manner to that illustrated, it is the height h1 which can be greater than the height h2. The deflection f can be directed upwards.

It should be noted that the features described above can be used independently of each other and in particular independently of the "Auto Transfer" feature of a press.

In this manner, and purely by way of example, the features relating to the height differences h2 and h1 can be used with printing units which have fewer throw-off configurations than in the example described.

In this manner, printing units of this type may, for example, not have a blanket-changing throw-off configuration. The blanket-changing operation cannot be carried out when the press 1 is carrying out another printing operation.

In the same manner, the possibility of breakage of the rods 40A and 40B can be used independently of the throw-off configurations described above and the different extents of movement of the blanket cylinders. It is also possible to use rods of this type for only one of the printing groups.

More generally, other elements of the support and movement mechanism 26 can, in addition to or in place of the rods 40A and 40B, have a zone of lesser strength in order to form a mechanical fuse. Preferably, when an element of this type is present, it will be provided with a breakage detector.

It should also be noted that the first safety measure described above in order to limit the risks of damage to the cylinders can also be achieved with other support and movement mechanisms 26. In this manner, the two spaces 66A and 66B may have in this configuration, widths d1 and d2 which are greater than those which they have in the other throw-off configurations. Conversely, the possibility of enlargement described for the space 66B can also be implemented for the upper printing group 20A. This enlargement can thus be provided, not by a movement of the blanket cylinder, as described above, but by a movement of the plate cylinder or even by a movement of these two cylinders.

Arrangements of printing units other than those of FIG. 1 can be envisaged. For example, the units 7 and 11 may be intended to print in black, the units 8 and 12 in cyan, the units 9 and 13 in magenta and the units 10 and 14 in yellow.

In the same manner, the press 1 may include a different number of printing units from that in FIG. 1, preferably greater than 2, and all of the printing units do not necessarily have the structure described above.

Generally, the height H of the space 64 in the throw-off configurations will be, for example, greater than 10 mm in order to allow the web 3 to pass through the printing units which are not printing, without touching the blanket cylinders thereof. However, this value must not be considered to be limiting, other lower values being able to allow this object to be achieved.

In reality, the height H which allows the web 3 of paper to pass through without touching the blanket cylinders is dependent in particular on the diameter of the blanket cylinders, the inclination of the line L relative to the vertical, the distance between the successive printing units and the tack of the ink.

Finally, the significant heights H obtained owing to the press 1 described and the variants thereof are also found to be advantageous in facilitating the engagement of the web 3 of paper in the manner described below with reference to FIG. 10.

In this Figure, only the walls 29 of the frame 28 and the blanket cylinders 22A and 22B of the printing unit 8 have been illustrated, and the main elements of a system 69 for engaging the web 3 of paper.

These elements include a traction bar 70 which extends inside the frame 28 parallel with the axes of the cylinders 22A and 22B substantially over the entire length thereof. The lateral ends of this bar 70 are mounted in a releasable manner, each on a lateral chain 72. These lateral chains 72 are, for example, endless chains. Only one of the strands 74 of these chains 72 is illustrated in FIG. 10, the return strands not having been illustrated.

Each strand 74 extends at one side of the press 1, through all the printing units 7 to 14.

It is optionally guided in a horizontal slide 76 which is partially illustrated. Other devices for guiding the chains 72 and in particular the strands 74 can be envisaged. It should be noted that the slide 76 which is located at the side of the doors 35A and 35B remains fixed and it is not necessary for it to be retracted to change the blankets.

Figure 10:
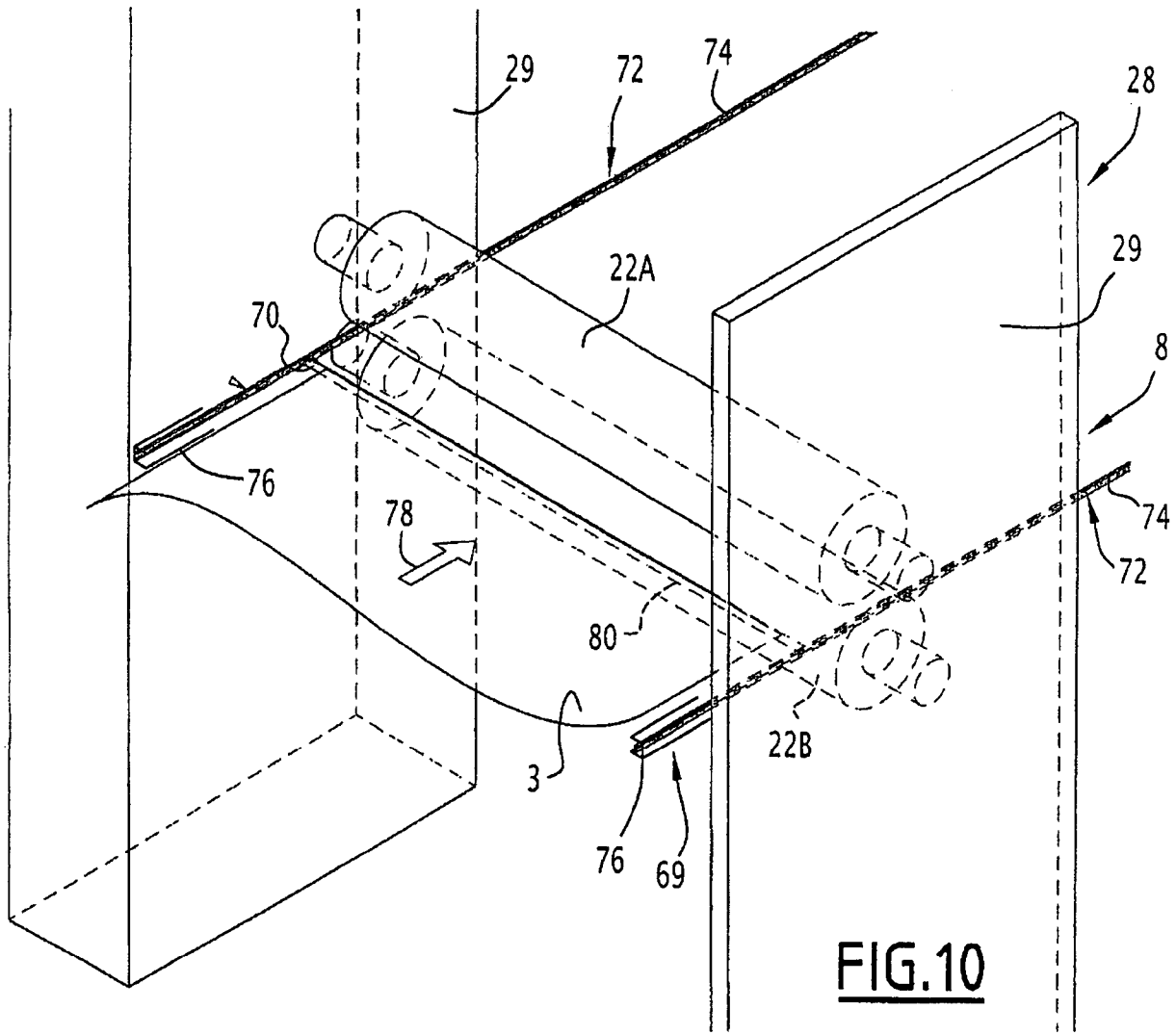
FIG. 10 is a perspective schematic view of the printing unit of FIG. 2, illustrating a system for engaging the web of paper.

The press 1 also includes a motor which allows the chains 72 to be driven so as to be able to bring about a horizontal movement of the bar 70 of the printing unit 7 towards the printing unit 14, as indicated by the arrow 78 in FIG. 10.

In order to bring about the engagement of the web 3, after the units 7 to 14 of the press have been placed in one of the throw-off configurations, the ends of the bar 70 are fixed to the chains 72 at the input of the printing unit 7. The leading edge 80 of the web 3 of paper has been fixed beforehand or is fixed to the bar 70, then the movement of the bar 70 is brought about as indicated by the arrow 78.

The bar 70 pulls the web 3 of paper through the units 7 to 14 of the press and an operator can then recover the leading edge 80 of the web 3 as it leaves the printing unit 14.

The operation for engaging the web in the printing units 7 to 14 can therefore be carried out by only one person in one action.

It is therefore particularly simple, rapid and inexpensive to implement.

Furthermore, the traction of the web 3 in the printing units owing to the bar 70, compared with conventional web engagement systems in which the web is pulled from only one of the sides thereof, allows a correct centering of the web 3 in the printing units to be maintained.

The significant heights H of the spaces 64 are found to be particularly advantageous for such a method of engagement of the web 3 since they allow the bar 70 to have a relatively large diameter, preventing detrimental occurrences of flexion.

It should also be noted that, in order to further facilitate the operations for engagement of the webs, the bar 70 can be the one used for the operations for engaging the web 3 in the unwinding devices 5 and the dryer/cooler 16. The bar 70 is capable of being mounted on the driving devices and in the guides of the web engagement systems which these other elements of the press 1 may be provided with.

The engagement of the web 3 in the press 1 is thus even more simple.

Generally, the bar 70 can be moved by types of chain other than endless chains 72, or even by other driving devices. These driving devices may be provided at only one side of the press 1 and not at both sides as illustrated in FIG. 10.

This type of engagement of the web can be used with a press 1 including only an unwinding device, including a dryer and a cooler which are separate and/or not including a dryer.

In the same manner, this type of engagement of the web 3 in the printing units of the press can be used independently of the features described above and in particular those relating to the dimensions obtained for the height H of the spaces 64.

Figure 11:
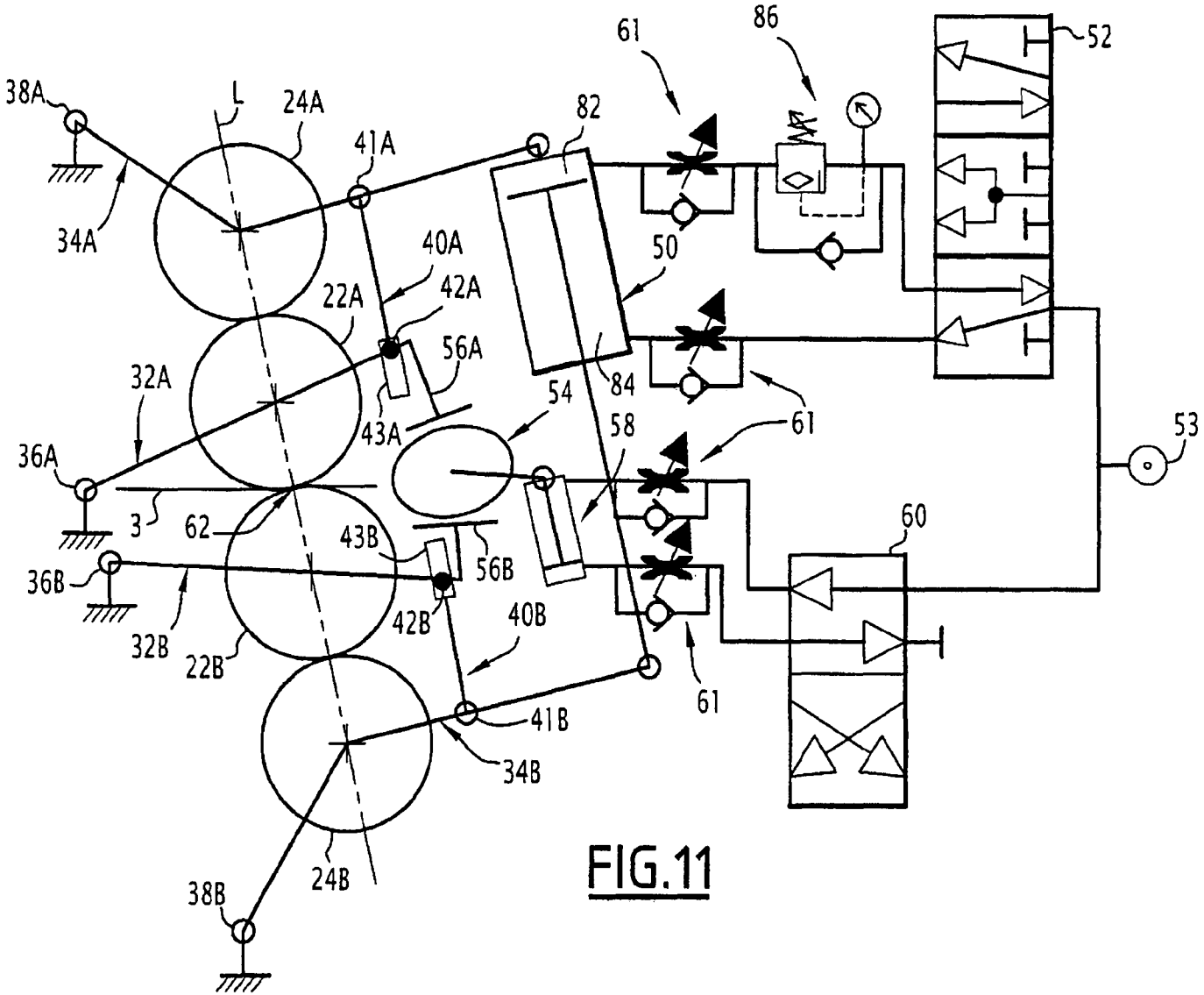
FIG. 11 is a view similar to FIG. 4, illustrating a variant of the printing unit of FIGS. 2 to 7.

FIG. 11 illustrates a variant of the unit 8 of FIGS. 1 to 7; the valve 52 has been replaced in this instance with a valve having five holes and three positions. This valve 52 therefore has a supplementary position referred to as resilient centering. In this supplementary position, the two outlet holes of the valve 52 are supplied with air from the source 53. The two chambers 82 and 84 located at one side and the other of the piston of the jack 50 are therefore supplied with compressed air.

The sequence for moving from the throw-on configuration to the idle throw-off configuration is as follows.

The valve 52 first moves into a resilient centering position. The air pressures in the chambers 82 and 84 are therefore balanced and the cylinders 22B and 24B of the lower printing group 20B are lowered under the action of their own weight.

After the cylinders 22B and 24B have reached their idle throw-off positions, which can be confirmed, for example, by detectors with which the printing unit 8 is equipped, the control unit of the press 1 brings about the movement of the valve 52 into the position in which the chamber 82 is supplied with compressed air and the chamber 84 is ventilated.

This causes the cylinders 22A and 24A of the upper printing group 20A to rise until they reach their idle throw-off positions.

This sequence allows impacts to be damped since the cylinders of the lower printing group 20B are lowered primarily under the effect of their own weight.

It is also possible to provide a pressure limitation device 86 as illustrated in FIG. 11.

This pressure limitation device 86, when it is arranged as in FIG. 11, upstream of the chamber 82, allows the pressure to be reduced in this chamber 82 relative to that in the chamber 84, when the valve 52 is in a resilient centering position. The pressure limitation device 86 allows the descent of the cylinders of the lower printing group 20B to be further decelerated when moving into the idle throw-off configuration.

If a pressure limitation device 86 is placed upstream of the chamber 84, an acceleration of the descent of the cylinders of the lower group 20B is achieved.

It should be noted that the features described with reference to FIG. 11 can be used separately from those described above and can be used generally in a printing unit which has a throw-on configuration and at least one throw-off configuration.

What is claimed is:

1. A printing unit for printing a web of paper comprising:

a frame;

at least an upper printing group and a lower printing group, the upper printing group including an upper blanket cylinder and an upper plate cylinder, the lower printing group including a lower blanket cylinder and a lower plate cylinder;

a cylinder support and movement mechanism moving the printing unit into at least one throw-on configuration and at least one throw-off configuration; and a controller for controlling the cylinder support and movement mechanism to move the upper blanket cylinder and lower blanket cylinder into the at least one throw-on configuration wherein the upper blanket cylinder is pressed against the lower blanket cylinder and the upper and lower blanket cylinders are pressed against the upper and lower plate cylinders, respectively, and the at least one throw-off configuration wherein the upper blanket cylinder is spaced apart from the lower blanket cylinder, such that the upper blanket cylinder is raised by a first height in the at least one throw-off configuration with respect to a position the upper blanket cylinder occupies in the at least one throw-on configuration, and the lower blanket cylinder is lowered by a second height in the at least one throw-off configuration with respect to another position the lower blanket cylinder occupies in a throw-on configuration, wherein the second height is different from the first height.

2. The printing unit as recited in claim 1 wherein the second height is greater than the first height.

3. The printing unit as recited claim 1 wherein the at least one throw-off configuration is a plate-changing throw-off configuration, the upper and lower blanket cylinders being pressed against the upper and lower plate cylinders respectively.

4. The printing unit as recited in claim 1 wherein the at least one throw-off configuration is a blanket-changing throw-off configuration, the upper and lower blanket cylinders being spaced apart from the upper and lower plate cylinders respectively.

5. The printing unit as recited in claim 1 wherein the at least one throw-off configuration is an idle throw-off configuration, the upper and lower blanket cylinders being spaced apart from the upper and lower plate cylinders respectively.

6. The printing unit as recited in claim 5 wherein in the idle throw-off configuration a width of a space between the upper or lower blanket cylinder and the upper or lower plate cylinder, respectively, is greater than a width of the space when the printing unit is in a blanket-changing throw-off configuration.

7. The printing unit as recited in claim 5 wherein in the idle throw-off configuration the support and movement mechanism allows movement of the upper or lower blanket cylinder or the upper or lower plate cylinder so a width of a space between the upper or lower blanket cylinder and the upper or lower plate cylinder respectively, is greater than a width of the space when the printing unit is in a blanket-changing throw-off configuration.

8. The printing unit as recited in claim 1 wherein the support and movement mechanism includes receiving arms, the receiving arms articulated to the frame and pivotable about axes parallel with the upper and lower plate cylinders and upper and lower blanket cylinders, the receiving arms supporting ends of the upper and lower plate cylinders and upper and lower blanket cylinders.

9. The printing unit as recited in claim 8 wherein the support and movement mechanism includes connections between the receiving arms that receive the upper or lower blanket cylinder and upper or lower plate cylinder respectively.

10. The printing unit as recited in claim 1 wherein the at least one throw-off configuration includes a web of paper printed by another printing unit passing through space between the upper and lower blanket cylinders.

11. A printing press comprising at least one upstream printing unit and one downstream printing unit, the downstream printing unit being a printing unit as recited in claim 1.

12. The printing press as recited in claim 11 wherein there are no additional supports for the web of paper between the upstream printing unit and the downstream printing unit.

* * * * *